US007105479B2

(12) United States Patent
Ehlis et al.

(10) Patent No.: US 7,105,479 B2
(45) Date of Patent: Sep. 12, 2006

(54) FABRIC RINSE COMPOSITION CONTAINING A BENZTRIAZOLE UV ABSORBER

(75) Inventors: Thomas Ehlis, Freiburg (DE); Robert Hochberg, Freiburg (DE); Hauke Rohwer, Lörrach (DE)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 245 days.

(21) Appl. No.: 10/472,791

(22) PCT Filed: Mar. 19, 2002

(86) PCT No.: PCT/EP02/03009

§ 371 (c)(1),
(2), (4) Date: Sep. 24, 2003

(87) PCT Pub. No.: WO02/077148

PCT Pub. Date: Oct. 3, 2002

(65) Prior Publication Data

US 2004/0111805 A1 Jun. 17, 2004

(30) Foreign Application Priority Data

Mar. 27, 2001 (EP) ..... 01810310

(51) Int. Cl.
*C11D 3/28* (2006.01)

(52) U.S. Cl. ..... 510/461

(58) Field of Classification Search ..... 510/461, 510/516

See application file for complete search history.

(56) References Cited

U.S. PATENT DOCUMENTS

| | | | | |
|---|---|---|---|---|
| 3,629,192 A | | 12/1971 | Heller et al. | 260/45.8 |
| 5,081,258 A | * | 1/1992 | Kawaguchi | 548/260 |
| 5,810,889 A | | 9/1998 | Kaufmann et al. | 8/442 |
| 5,962,402 A | | 10/1999 | Severns | 510/518 |

FOREIGN PATENT DOCUMENTS

| | | | |
|---|---|---|---|
| CA | 2137212 | | 6/1995 |
| CH | 497919 | | 10/1970 |
| EP | 0657577 | | 6/1995 |
| EP | 0659877 | | 6/1995 |
| JP | 50-121178 | * | 9/1975 |
| WO | 89/03826 | | 5/1989 |
| WO | 00/25730 | | 5/2000 |

* cited by examiner

*Primary Examiner*—John R. Hardee
(74) *Attorney, Agent, or Firm*—Kevin T. Mansfield

(57) ABSTRACT

Disclosed is a fabric rinse composition comprising a) 0.1 to 10% by weight of a UV absorber of formula (1), wherein A is a radical of formula (1a); B is a radical of formula (1c); (1d); (1e); (1f), (1g); (1b); (1i); (1k); (1l); or (1m); $R_1$, $R_2$, $R_3$, $R_4$, $R_5$ and $R_6$ are each independently of the others hydrogen, $C_1$–$C_{18}$alkyl; $C_5$–$C_7$-cycloalkyl; halogen; $R_9$ is hydrogen $C_1$–$C_{12}$hydroxyalkyl; or $C_5$–$C_7$cycloalkyl; $R_7$, $R_8$ and $R_{10}$ are each independently of the others hydrogen, $C_1$–$C_{18}$alkyl, $C_5$–$C_7$cycloalkyl, $C_1$–$C_{12}$hydroxyalkyl; X is halogen; a radical of formula (1s); or (1u); sulfate, phosphate, lactate, citrate, tartrate; $R_{11}$ is $C_1$–$C_{12}$alkyl; $C_5$–$C_7$cycloalkyl or phenyl: x is from 0 to 10; and y is from 1 to 20; b) 5 to 25% by weight, based on the total weight of the composition of a fabric softener agent; and c) the remainder being substantially water (1)

(1a)

(1b)

(1c)

(1d)

(1e)

(1f)

(1g)

(1h)

-continued
(1i)
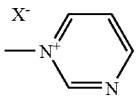
(1k)
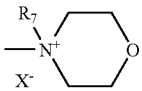
(1l)
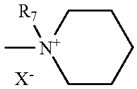
(1m)
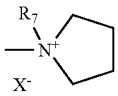
-continued
(1s)
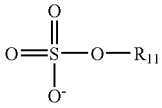
(1t)
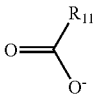
(1u)
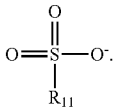
18 Claims, No Drawings

FABRIC RINSE COMPOSITION CONTAINING A BENZTRIAZOLE UV ABSORBER

The present invention relates to a fabric rinse composition containing a benztriazole UV absorber; and to a method of treating textiles with the composition, which method imparts to textile fiber material so treated, in addition to an excellent UV Protecting Factor (UPF) value, and other desirable properties.

It is known that light radiation of wavelengths 280–400 nm permits tanning of the epidermis. Also known is that rays of wavelengths 280–320 nm (termed UV-B radiation), cause erythemas and skin burning which can inhibit skin tanning.

Radiation of wavelengths 320–400 nm (termed UV-A radiation) is known to induce skin tanning but can also cause skin damage, especially to sensitive skin which is exposed to sunlight for long periods. Examples of such damage include loss of skin elasticity and the appearance of wrinkles, promotion of the onset of erythemal reaction and the inducement of phototoxic or photoallergic reactions.

Any effective protection of the skin from the damaging effects of undue exposure to sunlight clearly needs to include means for absorbing both UV-A and UV-B components of sunlight before they reach the skin surface.

Traditionally, protection of exposed human skin against potential damage by the UV components in sunlight has been effected by directly applying to the skin a preparation containing a UV absorber.

One aspect of the desire to increase the level of skin protection against sunlight has been the consideration of additional measures, over and above the direct protection of the skin. For example, consideration has been given to the provision of protection to skin covered by clothing and thus not directly exposed to sunlight.

Most natural and synthetic textile materials are at least partially permeable to UV components of sunlight. Accordingly, the mere wearing of clothing does not necessarily provide skin beneath the clothing with adequate protection against damage by UV radiation. Although clothing containing a deeply colored dye and/or having a tight weave texture may provide a reasonable level of protection to skin beneath it, such clothing is not practical in hot sunny climates, from the standpoint of the personal comfort of the wearer.

There is a need, therefore, to provide protection against UV radiation for skin which lies underneath clothing, including lightweight summer clothing, which is undyed or dyed only in pale shades. Depending on the nature of the dyestuff, even skin beneath clothing dyed in some dark shades may also require protection from UV radiation.

Such lightweight summer clothing normally has a density of less than 200 g/m$^2$ and has a sun protection factor rating between 1.5 and 20, depending on the type of fibre from which the clothing is manufactured.

The UPF rating of a sun protectant (sun cream or clothing) may be defined as the multiple of the time taken for the average person wearing the sun protectant to suffer sun burning under average exposure to sun. For example, if an average person would normally suffer sun burn after 30 minutes under standard exposure conditions, a sun protectant having an UPF rating of 5 would extend the period of protection from 30 minutes to 2 hours and 30 minutes. For people living in especially sunny climates, where mean sun burn times are minimal, e.g. only 15 minutes for an average fair-skinned person at the hottest time of the day, UPF ratings of about 20 are desired for lightweight clothing.

The selection of a suitable UVA, for use in a method for effecting an increase in the UPF value of a textile fiber material (often referred to as a "UV cutting" treatment method), has to take into account the fact that the treated textile fiber material must satisfy performance criteria in a wide range of areas, such as washfastness, lightfastness and tear resistance, apart from its UPF value.

Another major problem for consumers in many parts of the world is the fading of colored fabrics by sunlight (so-called "photo-fading") during wear and during drying. Thus susceptible fabrics in temperature and high latitude regions in addition to those in the tropics can be severely faded. Photo-fading of fabrics is of specific concern to consumers because the contrast between exposed and unexposed areas makes it particularly noticeable.

Surprisingly it was found that the use of specific UV absorbers in a fabric rinse composition imparts enhanced UPF, and simultaneously effectively prevents the photo-fading of said fabric.

Therefore the present invention provides a stable, concentrated fabric rinse composition comprising fabric rinse composition comprising a) 0.1 to 10, preferably 0.1 to 5% by weight of a UV absorber of formula (1)

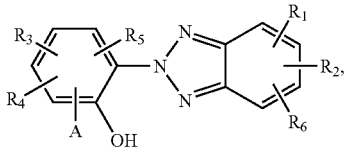

wherein

A is a radical of formula (1a)

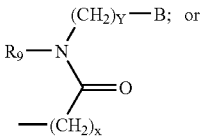

(1b)

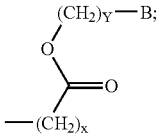

B is a radical of formula (1c)

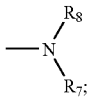

-continued (1d)

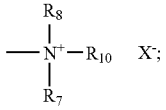

(1e)

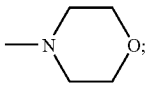

(1f)

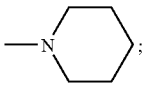

(1g)

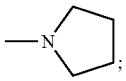

(1h)

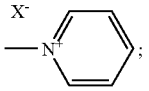

(1i)

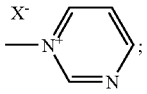

(1k)

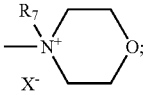

(1l)

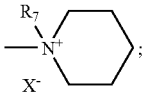

or (1m)

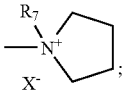

$R_1$, $R_2$, $R_3$, $R_4$, $R_5$ and $R_6$ are each independently of the others hydrogen, $C_1$–$C_{18}$alkyl; $C_5$–$C_7$-cycloalkyl; halogen;

$R_9$ is hydrogen, $C_1$–$C_{12}$alkyl; or $C_5$–$C_7$cycloalkyl;

$R_7$, $R_8$ and $R_{10}$ are each independently of the others hydrogen, $C_1$–$C_{12}$alkyl, $C_5$–$C_7$cycloalkyl, $C_1$–$C_{12}$hydroxyalkyl;

X is halogen; a radical of formula (1s)

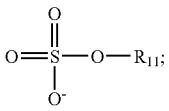

(1t)

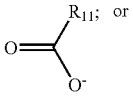

or (1u)

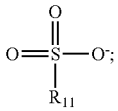

sulfate, phosphate, lactate, citrate, tartrate;

$R_{11}$ is $C_1$–$C_{12}$alkyl; $C_5$–$C_7$cycloalkyl or phenyl;

x is from 0 to 10; and y is from 1 to 20;

b) 5 to 25% by weight, based on the total weight of the composition of a fabric softener agent; and c) the remainder being substantially water.

The invention preferably relates to the use of a composition, wherein component (a) corresponds to the compounds of formulae (2)

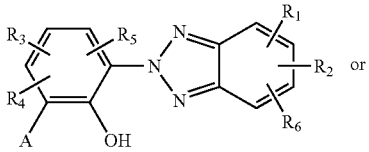

or (3)

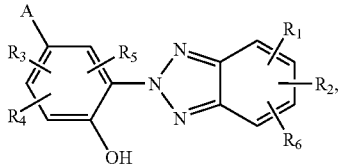

wherein $R_1$, $R_2$, $R_3$, $R_4$, $R_5$, $R_6$ and A are as defined for formula (1).

According to the invention there are preferably used as component (a) compounds of formulae (1), (2) and (3) wherein A is a radical of formula (1a)

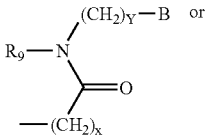

or (1b)

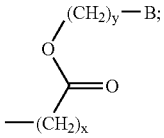

wherein

B is a radical of formula (1c); or (1d); and x and y are as defined for formula (1).

Special preference is given to compounds of formulae (1), (2) and (3) wherein $R_9$ is hydrogen; or $C_1$–$C_5$alkyl.

The following benzotriazole UV absorbers used according to the invention may be mentioned by way of example:

(4)
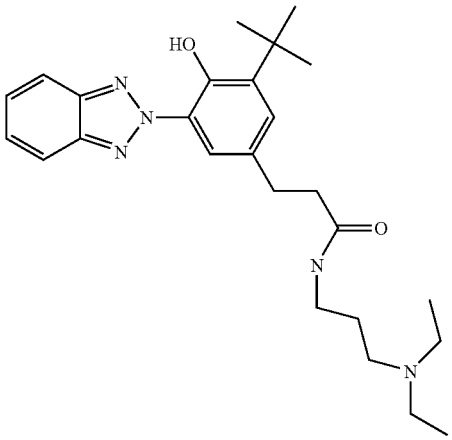
;
(5)
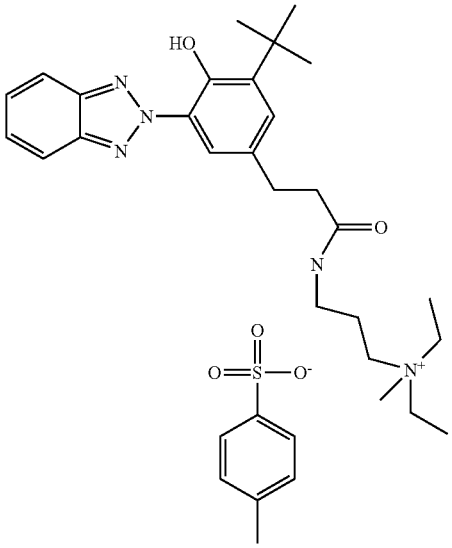
;
(6)
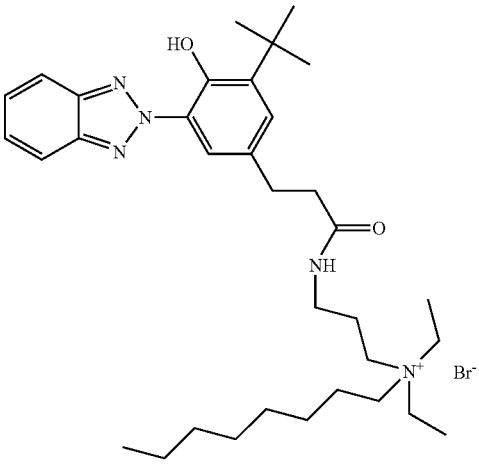
;
-continued
(7)
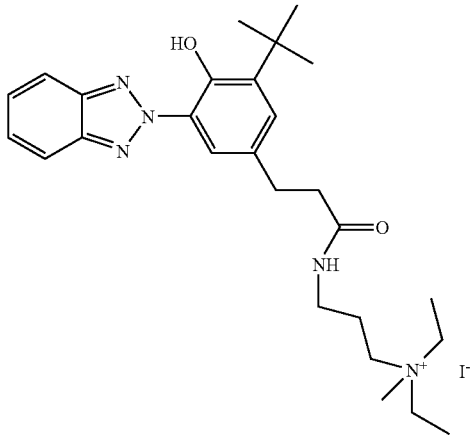
;
(8)
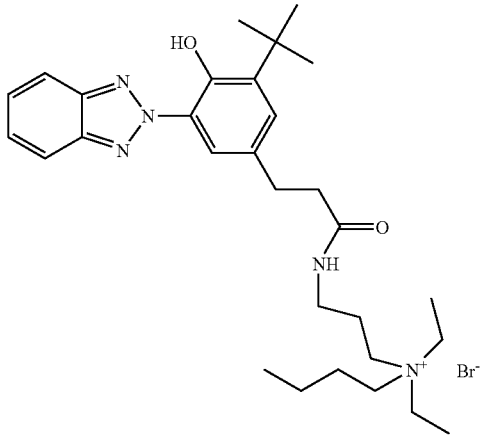
;
(9)
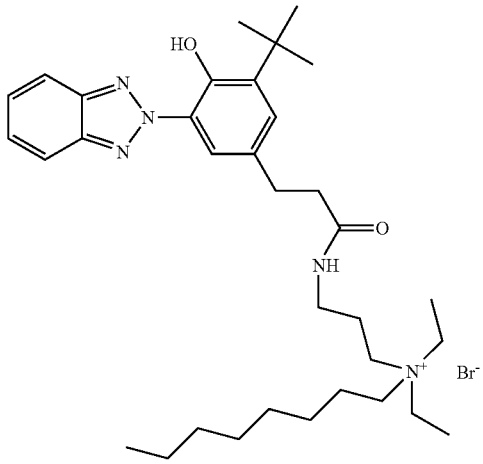
;

-continued (10)

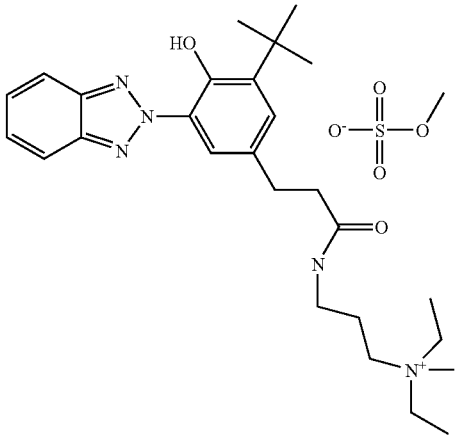

;

(11)

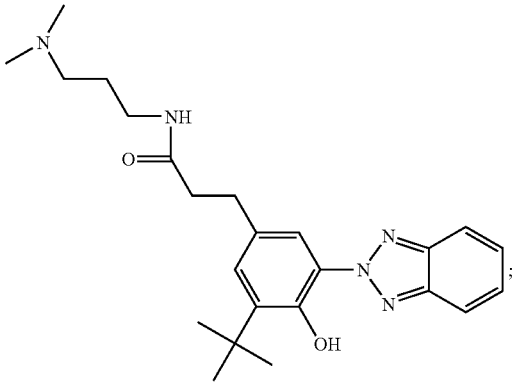

;

(12)

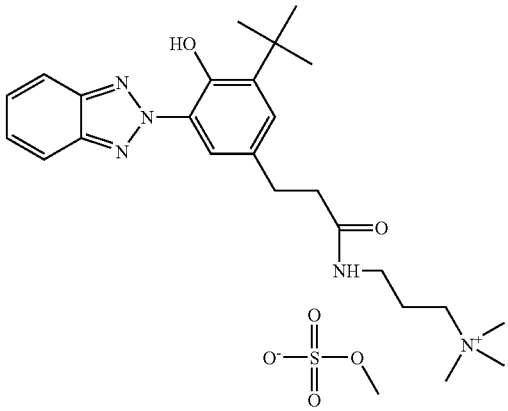

;

(13)

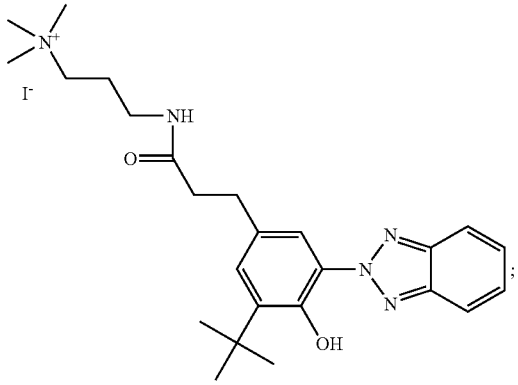

;

-continued (14)

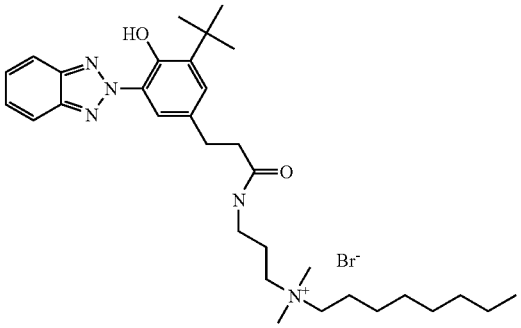

; and (15)

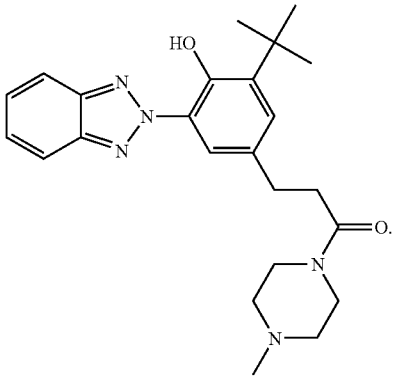

The UV absorber used in the present composition readily absorbs UV light, especially in the range I=300 to 400 nm, and converts the absorbed energy, by a chemical intermediate reaction, into non-interfering, stable compounds or into non-interfering forms of energy. The UV absorber should, of course, be compatible with the rinse cycle fabric softener composition. Preferably, the UV absorber used is one which is capable of being absorbed on to the washed textile article during a rinse cycle fabric softener treatment.

Fabric softeners (component (b)) suitable for use herein are selected from the following classes of compounds:

(i) Cationic quaternary ammonium salts. The counter ion of such cationic quaternary ammonium salts may be a halide, such as chloride or bromide, methyl sulfate, or other ions well known in the literature. Preferably the counter ion is methyl sulfate or any alkyl sulfate or any halide, methyl sulfate being most preferred for the dryer-added articles of the invention.

Examples of cationic quaternary ammonium salts include but are not limited to:

1. Acyclic quaternary ammonium salts having at least two $C_8$ to $C_{30}$, preferably $C_{12}$ to $C_{22}$ alkyl or alkenyl chains, such as: ditallowdimethyl ammonium methylsulfate, di(hydrogenated tallow)dimethyl ammonium methylsulfate, distearyldimethyl ammonium methylsulfate or chloride, dicocodimethyl ammonium methylsulfate and the like. It is especially preferred if the fabric softening compound is a water insoluble quaternary ammonium material which comprises a compound having two $C_{12}$ to $C_{18}$ alkyl or alkenyl groups connected to the molecule via at least one ester link. It is more preferred if the quaternary ammonium material has two ester links present. An especially preferred ester-linked quaternary ammonium material for use in the invention can be represented by the formula:

(16)

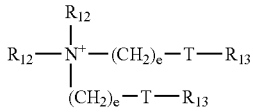

wherein each $R_{12}$ group is independently selected from $C_1$ to $C_4$ alkyl, hydroxyalkyl or $C_2$ to $C_4$ alkenyl groups; T is either (16a)

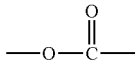

or (16b)

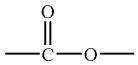

and wherein each $R_{13}$ group is independently selected from $C_8$ to $C_{28}$ alkyl or alkenyl groups; and e is an integer from 0 to 5.

A second preferred type of quaternary ammonium material can be represented by the formula:

(17)

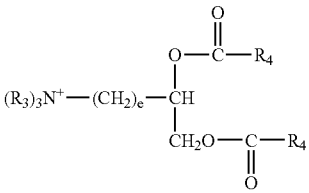

wherein $R_4$, $R_5$ and e are as defined in formula (16).

2. Cyclic quaternary ammonium salts of the imidazolinium type such as di(hydrogenated tallow)dimethyl imidazolinium methylsulfate, 1-ethylene-bis(2-tallow-1-methyl) imidazolinium methylsulfate and the like;
3. Diamido quaternary ammonium salts such as: methyl-bis (hydrogenated tallow amidoethyl)-2-hydroxethyl ammonium methyl sulfate, methyl bi(tallowamidoethyl)-2-hydroxypropyl ammonium methylsulfate and the like;
4. Biodegradable quaternary ammonium salts such as N,N-di(tallowoyl-oxy-ethyl)-N,N-dimethyl ammonium methyl sulfate and N,N-di(tallowoyl-oxy-propyl)-N,N-dimethyl ammonium methyl sulfate. Biodegradable quaternary ammonium salts are described, for example, in U.S. Pat. Nos. 4,137,180, 4,767,547 and 4,789,491 incorporated by reference herein.

Preferred biodegradable quaternary ammonium salts include the biodegradable cationic diester compounds as described in U.S. Pat. No. 4,137,180, herein incorporated by reference.

(ii) Tertiary fatty amines having at least one and preferably two $C_8$–$C_{30}$, preferably $C_{12}$–$C_{22}$ alkyl chains. Examples include hardened tallow-di-methylamine and cyclic amines such as 1-(hydrogenated tallow)amidoethyl-2-(hydrogenated tallow)imidazoline. Cyclic amines which may be employed for the compositions herein are described in U.S. Pat. No. 4,806,255 incorporated by reference herein.

(iii) Carboxylic acids having 8 to 30 carbons atoms and one carboxylic group per molecule. The alkyl portion has 8 to 30, preferably 12 to 22 carbon atoms. The alkyl portion may be linear or branched, saturated or unsaturated, with linear saturated alkyl preferred. Stearic acid is a preferred fatty acid for use in the composition herein. Examples of these carboxylic acids are commercial grades of stearic acid and palmitic acid, and mixtures thereof which may contain small amounts of other acids.

(iv) Esters of polyhydric alcohols such as sorbitan esters or glycerol stearate. Sorbitan esters are the condensation products of sorbitol or iso-sorbitol with fatty acids such as stearic acid. Preferred sorbitan esters are monoalkyl. A common example of sorbitan ester is SPAN 60 (ICI) which is a mixture of sorbitan and isosorbide stearates.

(v) Fatty alcohols, ethoxylated fatty alcohols, alkyphenols, ethoxylated alkyphenols, ethoxylated fatty amines, ethoxylated monoglycerides and ethoxylated diglycerides.

(vi) Mineral oils, and polyols such as polyethylene glycol.

These softeners are more definitively described in U.S. Pat. No. 4,134,838 the disclosure of which is incorporated by reference herein. Preferred fabric softeners for use herein are acyclic quaternary ammonium salts. Di(hydrogenated) tallowdimethyl ammonium methylsulfate is most widely used for dryer articles of this invention. Mixtures of the above mentioned fabric softeners may also be used.

In addition, the composition according to the present invention may also contain a minor proportion of one or more adjuvants. Examples of adjuvants include emulsifiers, perfumes, colouring dyes, opacifiers, fluorescent whitening agents, bactericides, nonionic surfactants, anti-gelling agents such as nitrites or nitrates of alkali metals, especially sodium nitrate, and corrosion inhibitors such as sodium silicate.

The amount of each of these optional adjuvants preferably ranges from 0.05 to 5% by weight of the composition.

A particularly preferred optional adjuvant is a cationic, amphoteric or anionic fluorescent whitening agent as disclosed in EP-A-0,659,877, from page 9 to page 15, line 56.

The present invention also provides a method for the improvement of UPF of a textile article, comprising applying, to a previously washed article, a fabric rinse composition comprising:

a) 0.1 to 10, preferably 0.1 to 5% by weight of a UV absorber of formula (1), based on the total weight of the composition;
b) 5 to 25%, especially from 10 to 20% by weight, based on the total weight of the composition, of a fabric care ingredient; and
c) the remainder being substantially water.

The method and composition of the present invention, in addition to providing protection to the skin, also increase the useful life of a textile article treated according to the present invention, for example by preserving its tear strength and/or its lightfastness or reducing the fading from sunlight.

Therefore the present invention also provides a method for the reducing of the fading of fabrics from sunlight, comprising applying, to a previously washed article, a fabric rinse composition comprising:

a) 0.1 to 10, preferably 0.1 to 5% by weight of a UV absorber of formula (1), based on the total weight of the composition;
b) 5 to 25%, especially from 10 to 20% by weight, based on the total weight of the composition, of a fabric care ingredient; and
c) the remainder being substantially water.

The composition deposit from about 0.5 mg/g fabric to about 5 mg/g fabric of the UV absorber of formula (1) onto the fabric to reduce the sun fading of fabric.

The textile article treated according to the method of the present invention may be composed of any of a wide range of types of fibers such as wool, polyamide, cotton, polyester, polyacrylic, silk or any mixture thereof.

Treatment of fabric with compositions of the present invention repeatedly during the rinse cycle of a typical laundering process may result in higher deposition levels, which contributes even further to the sun-fading benefit.

The following Examples further illustrate the present invention.

EXAMPLE 1

5 g of bleached cotton fabric (weave) are washed/rinsed in a linitest applying the following conditions:

Main Wash:

| | |
|---|---|
| Detergent dosage: | 4 g/l ECE 77 (phosphate containing standard detergent which is free of fluorescent whitening and bleaching agents) |
| Liquor ratio: | 1:20 |
| Duration: | 15 minutes |
| Temperature: | 25° C. |

Rinsing is carried out with tap water for 30 seconds and the spin dried.

Rinse Bath:

| | |
|---|---|
| Softener dosage: | 1.66 g/l concentrated Esterquat or 5 g/l diluted DSDMAC |
| Liquor ration: | 1:40 |
| Duration: | 15 minutes |
| Temperature: | 25° C. |

The fabric is spin dried at 60° C.; 1 and 3 wash cycles.

TABLE 1

| | Softener formulation: | |
|---|---|---|
| | Esterquat formulation | DSDMAC formulation |
| Di-(palmcarboxyethyl)-hydroxyethyl-methylammonium-methosulfate (Rewoquat WE 38 DPG) | 15% active matter | — |
| Distearyl-dimethylammoniumchloride (Arquad 2 HT-75) | — | 5% active matter |
| $C_{12}$–$C_{13}$ fatyy alcohol ethoxylate with an average of 6 EO units (Dobanol 23-6, 5) | — | 0.5% |
| $MgCl_2$ | 0.1% | — |
| UV-Absorber of formulas (4), (6), (7), (8) and (12) | 2.4% | 0.8% |
| water | ad 100% | ad 100% |

The UPF of the dried softener treated goods are determined by measurement of the UV light transmitted through the textile, using a double grating spectrophotometer fitted with an Ulbricht bowl. Calculation of UPF is conducted as described by B. L. Diffey and J. Robson in J. Soc. Cosm. Chem. 40 (1989), pp. 130–131.

The results are shown in Table 2:

TABLE 2

| Compound of formula | softener formulation without UV absorber | (4) | (6) | (7) | (8) |
|---|---|---|---|---|---|
| DSDMAC formulation | | | | | |
| 1st wash/rinse | 3 | 13 | 13 | 11 | 11 |
| 3rd wash/rinse | 3 | 25 | 29 | 20 | 21 |
| Esterquat formulation | | | | | |
| 1st wash/rinse | 3 | 14 | 12 | 10 | 10 |
| 3rd wash/rinse | 3 | 26 | 25 | 23 | 24 |

The results in Table 1 and 2 clearly demonstrate the improvement of the UPF values of the cotton substrates treated with rinse compositions according to the present invention.

EXAMPLE 2

Photo Fading Inhibition

Six differently colored cotton fabrics

| | | |
|---|---|---|
| A: Reactive Black 005 | B: Reactive Red 226 | C: Reactive Blue 013 |
| D: Reactive Red 264 | E: Reactive Red 228 | |

are separately washed and rinsed in a Linitest applying the following conditions:

Main Wash:

| | |
|---|---|
| Detergent dosage: | 4 g/l ECE77 |
| Liquor Ration: | 1:20 |
| Duration: | 15 minutes |
| Temperature: | 25° C. |

The fabrics are rinsed with tap water for 30 seconds and spin dried.

Rinse Bath:

| | |
|---|---|
| Softener dosage: | 4 g/l DSDMAC formulation |
| Liquor ration: | 1:20 |
| Duration: | 15 minutes |
| Temperature: | 25° C. |

The fabric is spin dried at 60° C. and irradiated in an ATLAS Weather-O-Meter Ci65A under the following conditions:

| | |
|---|---|
| Filter: | Boro/Boro |
| Irradiation lamp: | 3.5 kw |
| Irradiation onto the fabric: | 0.22 W/m$^2$ |
| Dry bulb: | 29.3° C. |
| Wet bulb: | 21.9° C. |
| Wet bulb depression: | 7.3° C. |

-continued

| | |
|---|---|
| Rel. humidity | 43% |
| Duration: | 7 h |

10 wash/rinse/irradiation cycles

TABLE 3

| Softener formulation: | |
|---|---|
| | DSDMAC formulation |
| Distearyl-dimethylammoniumchloride (Arquad 2 HT-75) | — |
| $C_{12}$–$C_{13}$ fatyy alcohol ethoxylate with an average of 6 EO units (Dobanol 23-6, 5) | 0.5% |
| UV-Absorber | 0.8% of compound of formula (12) |
| water | ad 100% |

Effect Evaluation CIE Color Measurement

The CIE color system evaluates the color of a fabric sampel in terms of the L*, a*, b* coordinates which are determinded from spectrophotometer readings. (L*, a*, b* are as described in Colorimetry, $2^{nd}$ Edition, CIE Publication no. 15.2, published by Bureau, Central de la CIE, Paris 1982).

The ΔE value is defined by the following equation:

$$\Delta E=\{(L_f^*-L_i^*)^2+(a_f^*-a_i^*)^2+(b_f^*-b_i^*)^2\}^{1/2}$$

where the subscripts I and f refer to the values as measured with or without irradiation of the sample, respectively.

The CIE color measurements of the colored fabric washed/rinsed without UV-aborber/irradiated (reference=not irradiated) and the colored fabric washed/rinsed with UV-absorber/irradiated (reference=not irradiated) obtained the following results:

TABLE 4

| | ΔE 10 Cycles | |
|---|---|---|
| | without compound of formula (12) | with compound of formula (12) |
| A: | 8.9 | 7.8 |
| B: | 17.1 | 15.8 |
| C: | 6.2 | 5.1 |
| D: | 13.5 | 10.9 |
| E: | 14.1 | 11.7 |

The results in the table show that the colored cotton fabrics treated according to the process of the present invention show a remarkable photo-fading inhibition.

What is claimed is:

1. A fabric rinse composition comprising a) 0.1 to 10% by weight of a UV absorber of formula (1)

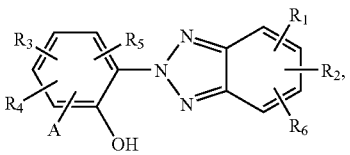

wherein

A is a radical of formula (1a)

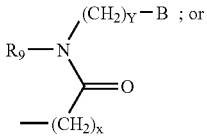

(1b)

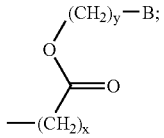

B is a radical of formula (1c)

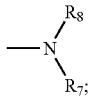

(1d)

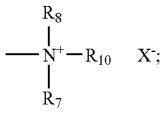

(1e)

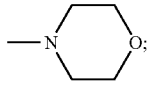

(1f)

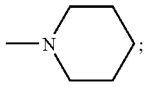

(1g)

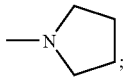

(1h)

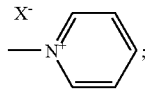

(1i)

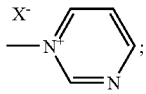

(1k)

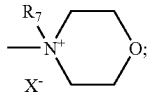

(1l)

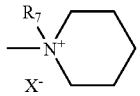

(1m)

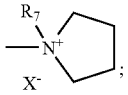

$R_1$, $R_2$, $R_3$, $R_4$, $R_5$ and $R_6$ are each independently of the others hydrogen, $C_1$–$C_{18}$alkyl;

$C_5$–$C_7$-cycloalkyl; or halogen;

$R_9$ is hydrogen, $C_1$–$C_{12}$alkyl; or $C_5$–$C_7$cycloalkyl;

$R_7$, $R_8$ and $R_{10}$ are each independently of the others hydrogen, $C_1$–$C_{12}$alkyl, $C_5$–$C_7$cycloalkyl, or $C_1$–$C_{12}$hydroxyalkyl;

X is halogen; a radical of formula (1s)

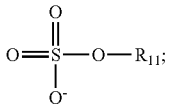

(1t)

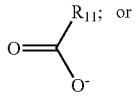

(1u)

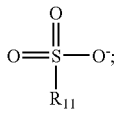

sulfate, phosphate, lactate, citrate, or tartrate;

$R_{11}$ is $C_1$–$C_{12}$alkyl; $C_5$–$C_7$cycloalkyl or phenyl;

x is from 2 to 10; and y is from 1 to 20;

b) 5 to 25% by weight, based on the total weight of the composition of a fabric softener agent; and c) the remainder being substantially water.

2. A composition according to claim 1 wherein component (a) corresponds to a UV absorber of formula (2)

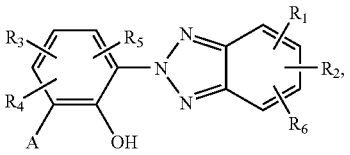

wherein $R_1$, $R_2$, $R_3$, $R_4$, $R_5$, $R_6$ and A are as defined in claim 1.

3. A composition according to claim 1, wherein component (a) corresponds to a UV absorber of formula (3)

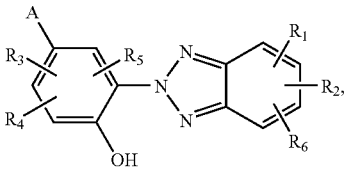

wherein $R_1$, $R_2$, $R_3$, $R_4$, $R_5$, $R_6$ and A are as defined in claim 1.

4. A composition according to claim 1 wherein

A is a radical of formula (1a)

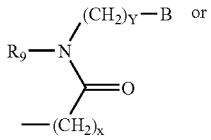

(1b)

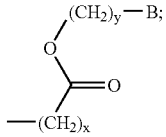

wherein

B is a radical of formula (1c); or (1d); and x and y are as defined in claim 1.

5. A composition according to claim 1 in which the fabric care ingredient is selected from the group consisting of cationic quaternary ammonium salts, tertiary fatty amines having at least one $C_8$–$C_{30}$ alkyl chain, carboxylic acids having 8 to 30 carbons atoms and one carboxylic group per molecule, esters of polyhydric alcohols, fatty alcohols, ethoxylated fatty alcohols, alkyphenols, ethoxylated alkyphenols, ethoxylated fatty amines, ethoxylated monoglycerides and ethoxylated diglycerides, mineral oils and polyols.

6. A composition according to claim 5, wherein the cationic quaternary ammonium salt fabric softener is selected from the group consisting of acyclic quaternary ammonium salts having at least two $C_8$ to $C_{30}$ alkyl or alkenyl chains, cyclic quaternary ammonium salts, diamido quaternary ammonium salts and biodegradable quaternary ammonium salts.

7. A composition according to claim 6, wherein the acyclic quaternary ammonium salts correspond to formula (16)

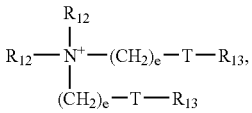

wherein each $R_{12}$ group is independently a $C_1$ to $C_4$ alkyl, hydroxyalkyl or $C_2$ to $C_4$ alkenyl group; T is either (16a)

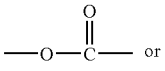

(16b)

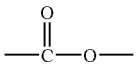

and wherein each $R_{13}$ group is independently a $C_8$ to $C_{28}$ alkyl or alkenyl group; and e is an integer from 0 to 5.

8. A composition according to claim 7, wherein the acyclic quaternary ammonium salts correspond to formula (17)

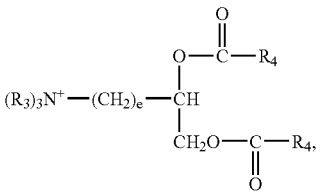

$R_4$, $R_5$ and e are as defined in claim 7.

9. A composition according to claim 7, wherein the acyclic quaternary ammonium salt is di-(palmcarboxy-ethyl)-hydroxyethyl-methylammonium-methosulfate.

10. A composition according to claim 6, wherein the acyclic quaternary ammonium salt is ditallowdimethyl ammonium methylsulfate, di(hydrogenated tallow)dimethyl ammonium methylsulfate, distearyldimethyl ammonium methylsulfate or chloride or dicocodimethyl ammonium methylsulfate.

11. A composition according to claim 5, in which the cyclic quaternary ammonium salt is di(hydrogenated tallow) dimethyl imidazolinium methylsulfate or 1-ethylene-bis(2-tallow-1-methyl)imidazolinium methylsulfate.

12. A composition according to claim 5, in which the diamido quaternary ammonium salt is methyl-bis(hydrogenated tallow amidoethyl)-2-hydroxethyl ammonium methyl sulfate or methyl bi(tallowamidoethyl)-2-hydroxypropyl ammonium methylsulfate.

13. A composition according to claim 5, in which the biodegradable quaternary ammonium salt is N,N-di(tallowoyl-oxy-ethyl)-N,N-dimethyl ammonium methyl sulfate or N,N-di(tallowoyl-oxy-propyl)-N,N-dimethyl ammonium methyl sulfate.

14. A composition according claim 1 which also contains an adjuvant which is an emulsifier, perfume, colouring dye, opacifier, fluorescent whitening agent, bactericide, nonionic surfactant, anti-gelling agent or corrosion inhibitor.

15. A method for the improvement of UPF of a textile article, comprising applying, to a previously washed article, a fabric rinse composition comprising a) 0.1 to 10% by weight of a UV absorber of formula (1) as defined in claim 1, based on the total weight of the composition;

b) 5 to 25% by weight, based on the total weight of the composition, of a fabric care ingredient; and c) the remainder being substantially water.

16. A method for reducing the fading of fabrics from sunlight, comprising applying, to a previously washed article, a fabric rinse composition comprising:

a) 0.1 to 10 by weight of a UV absorber of formula (1) as defined in claim 1, based on the total weight of the composition;

b) 5 to 25% based on the total weight of the composition, of a fabric care ingredient; and c) the remainder being substantially water.

17. A method according to claim 15 wherein the textile article treated is composed of wool, polyamide, cotton, polyester, polyacrylic, silk or any mixture thereof.

18. A method according to claim 16 wherein the textile article treated is composed of wool, polyamide, cotton, polyester, polyacrylic, silk or any mixture thereof.

* * * * *